US005549263A

United States Patent [19]

Maeng

[11] Patent Number: 5,549,263

[45] Date of Patent: Aug. 27, 1996

[54] SUPPORT STAND FOR GOLF BAG

[76] Inventor: Seop Maeng, P.O. Box 138-170, 22-102 Hangyang Apt. Songpa-dong, Songpa-gu, Seoul, Rep. of Korea

[21] Appl. No.: 353,068

[22] Filed: Dec. 9, 1994

[30] Foreign Application Priority Data

Dec. 9, 1993 [KR] Rep. of Korea ..... 26991

[51] Int. Cl.[6] ..... A63B 55/00

[52] U.S. Cl. ..... 248/96; 206/315.7

[58] Field of Search ..... 248/96, 168, 169; 206/315.7, 315.8, 315.3

[56] References Cited

U.S. PATENT DOCUMENTS

| | | | |
|---|---|---|---|
| 1,757,471 | 5/1930 | Platt | 248/96 |
| 4,676,464 | 6/1987 | Reimers | 248/96 |
| 4,921,192 | 5/1990 | Jones | 248/96 |
| 5,036,974 | 8/1991 | Ross, Jr. | 206/315.7 |
| 5,152,483 | 10/1992 | Maeng | 248/96 |
| 5,154,377 | 10/1992 | Suk | 248/96 |
| 5,209,350 | 5/1993 | Maeng | 206/315.7 |
| 5,236,085 | 8/1993 | Quellais | 206/315.7 |
| 5,351,921 | 10/1994 | Chen | 248/96 |
| 5,407,155 | 4/1995 | Chung | 248/96 |

*Primary Examiner*—Alvin C. Chin-Shue
*Assistant Examiner*—Derek J. Berger
*Attorney, Agent, or Firm*—John J. Connors; Connors & Associates

[57] ABSTRACT

A support stand for a golf bag including a pair of legs pivotally mounted to a body of the golf bag, an actuating member serving to pivotally move the legs and having upper ends each pivotally mounted to an upper portion of each corresponding one of the legs and a lower end being flush with a bottom surface of the golf bag body at an upright position of the golf bag, and a spacer bracket fixedly mounted at one end thereof to a lower portion of the golf bag body and provided with means for holding the lower portion of the actuating member, the spacer bracket being adapted to space the actuating member a predetermined distance from the golf bag body. The spacer bracket includes a screw threadedly coupled at one end thereof to one end of the spacer bracket and at the other end thereof to the other end of the spacer bracket, and an adjusting knob fixedly mounted on the screw.

8 Claims, 3 Drawing Sheets

SUPPORT STAND FOR GOLF BAG

BACKGROUND OF THE INVENTION

1. Field of the Invention

The present invention relates to a support stand for a golf bag, and more particularly to a support stand for a golf bag capable of moving a pair of legs between an extended position and a retracted position and adjusting the space between the legs at the extended position with a simple construction.

2. Description of the Prior Art

Conventionally, there have been proposed various golf bags which have legs movable between their extended and retracted positions. Such type of golf bags are disclosed in U.S. Pat. Nos. 4,676,464 and 4,921,192.

U.S. Pat. No. 4,676,464 discloses a golf bag with an integral stand which comprises a pair of legs pivotally mounted at the upper ends thereof on the upper portion of golf bag, a pair of shoulder pads connected at the upper ends thereof to the uppermost ends of the legs, respectively, and a pair of clamps fixedly mounted to the lower ends of the shoulder pads and adapted to fit around and slide along the legs, respectively. As the shoulder pads are lifted for carrying the golf bag, the clamps slide upwards along the legs, thereby causing the legs to be retracted. On the other hand, when the shoulder pads are free, the lower ends of the shoulder pads made of an elastic material such as nylon codes are extended by virtue of their elasticity, so that the clamps slide and push the legs, thereby causing the legs to extend in order to function as a stand. Thus, this construction has improved convenience in use, over the prior arts, because the legs are automatically retracted in carrying the golf bag and automatically extended in using or storage thereof.

However, this construction has inconvenience in storage, since even in storage, the legs are automatically extended. Also, to carry or store the golf bag under the condition of extending the legs causes the necessity of large space, thereby the transportation efficiency to be decreased.

Furthermore, the construction should have a base member of special shape which makes impossible to apply the construction to golf bags most commonly used.

In U.S. Pat. No. 4,921,192, a front half portion of the base of the bag is constructed inclinedly so that as the inclined base portion is brought into contact with the ground, a vertically extending actuating rod, which is disposed at the side of bag adjacent the inclined base portion and is movable upwards and downwards, is lifted to extend legs. This construction also have the disadvantage that it can not be used in general types of golf bags, because of requiring the inclined base. Furthermore, this inclined base causes the disadvantage that the golf bag falls down easily, in that the ground contact area thereof is only a part of the bottom surface of the base. In the case that golf clubs are contained in the golf bag, it is difficult to maintain the golf bag at its upright position because only the horizontal surface of the base should support the heavy weights of golf clubs. As a result, the golf bag is naturally maintained at its inclined position where the inclined surface of the base is in contact with the ground while legs are maintained at their extended position. Consequently, the golf bag can be hardly stored at its upright position under the condition of containing golf clubs therein. Large storage space is also needed because in storage, the legs are naturally maintained at their extended position.

Another golf bag stand has also been proposed in the Korean Utility Model No. 71035 issued to the applicant. The golf bag stand comprises an L-shaped actuating member provided at the lower end of a vertical movable member operatively connected to support legs. In this construction, however, the vertical movement length of the actuating member may vary depending on the ground condition, thereby causing the legs to be extended excessively or insufficiently. Where a golf bag with this construction is carried on a cart, its use is very inconvenient because of the length of the L-shaped actuating member. Furthermore, the L-shaped actuating member may be easily damaged or transformed. The damaged or transformed actuating member makes the overall stand useless. There is also disadvantages of complicated construction and expensive manufacture cost.

The Korean Utility Model Publication No. 93-7410 published in the name of the applicant discloses a golf bag stand with a more simple construction wherein legs are movable between an extended position and a retracted position by a pivotal movement of a pivoting member. However, this construction requires a manual work for pivotally mounting the pivoting member to the lower end of an actuating member and a golf bag. This manual work results in a large labor and an increase in manufacture cost. Where a golf bag with this construction is carried on a cart, its use is also very inconvenient because of the length of the pivoting member.

Most of existing golf bag stands have a constant leg extension width irrespective of the field ground condition and the number of golf clubs contained in the golf bag. For example, at a place with a slope or in the case where the number of golf clubs contained in the golf bag is large, legs are desirable to be extended a larger width in order to obtain a more stable support for the golf bag. However, there is no golf bag stand having a construction capable of adjusting the leg extension width.

SUMMARY OF THE INVENTION

Therefore, an object of the present invention is to overcome the above-mentioned disadvantages encountered in the prior arts and, thus, to provide a support stand for a golf bag having a simple construction capable of automatically extending legs upon storing or carrying the golf bag and automatically retracting the legs upon using the golf bag and thereby capable of reducing the labor taken for the manufacture thereof and the manufacture cost.

Another object of the present invention is to provide a support stand for a golf bag having a construction capable of adjusting the distance between the golf bag and an actuating member for moving legs between an extended position and a retracted position and thereby enabling the golf bag to be conveniently carried on a cart.

Another object of the present invention is to provide a support stand for a golf bag having a construction capable of adjusting the extension width of legs depending on a variation in circumstance and thereby supporting the golf bag more stably.

These object can be accomplished by providing a support stand for a golf bag comprising a pair of legs pivotally mounted to a body of the golf bag, further comprising: an actuating member serving to pivotally move the legs and having upper ends each pivotally mounted to an upper portion of each corresponding one of the legs and a lower end being flush with a bottom surface of the golf bag body at an upright position of the golf bag; and a spacer bracket fixedly mounted at one end thereof to a lower portion of the golf bag body and provided with means for holding the lower portion of the actuating member, the spacer bracket being adapted to space the actuating member a predetermined distance from the golf bag body.

The spacer bracket may have means for adjusting the distance between the actuating member and the golf bag body, the means comprising a screw threadedly coupled at one end thereof to one end of the spacer bracket and at the other end thereof to the other end of the spacer bracket and an adjusting knob fixedly mounted on the screw.

BRIEF DESCRIPTION OF THE DRAWINGS

Other objects and advantages of the present invention will become apparent from the following description of embodiments with reference to the accompanying drawings in which:

FIGS. 3*a* and 3*b* are schematic views explaining operations of the support stand shown in FIG. 1 or FIG. 2, wherein FIG. 3*a* shows an operation at an upright position of the golf bag whereas FIG. 3*b* shows an operation at a tilted position of the golf bag.

DETAILED DESCRIPTION OF THE PREFERRED EMBODIMENTS

Figure 1:
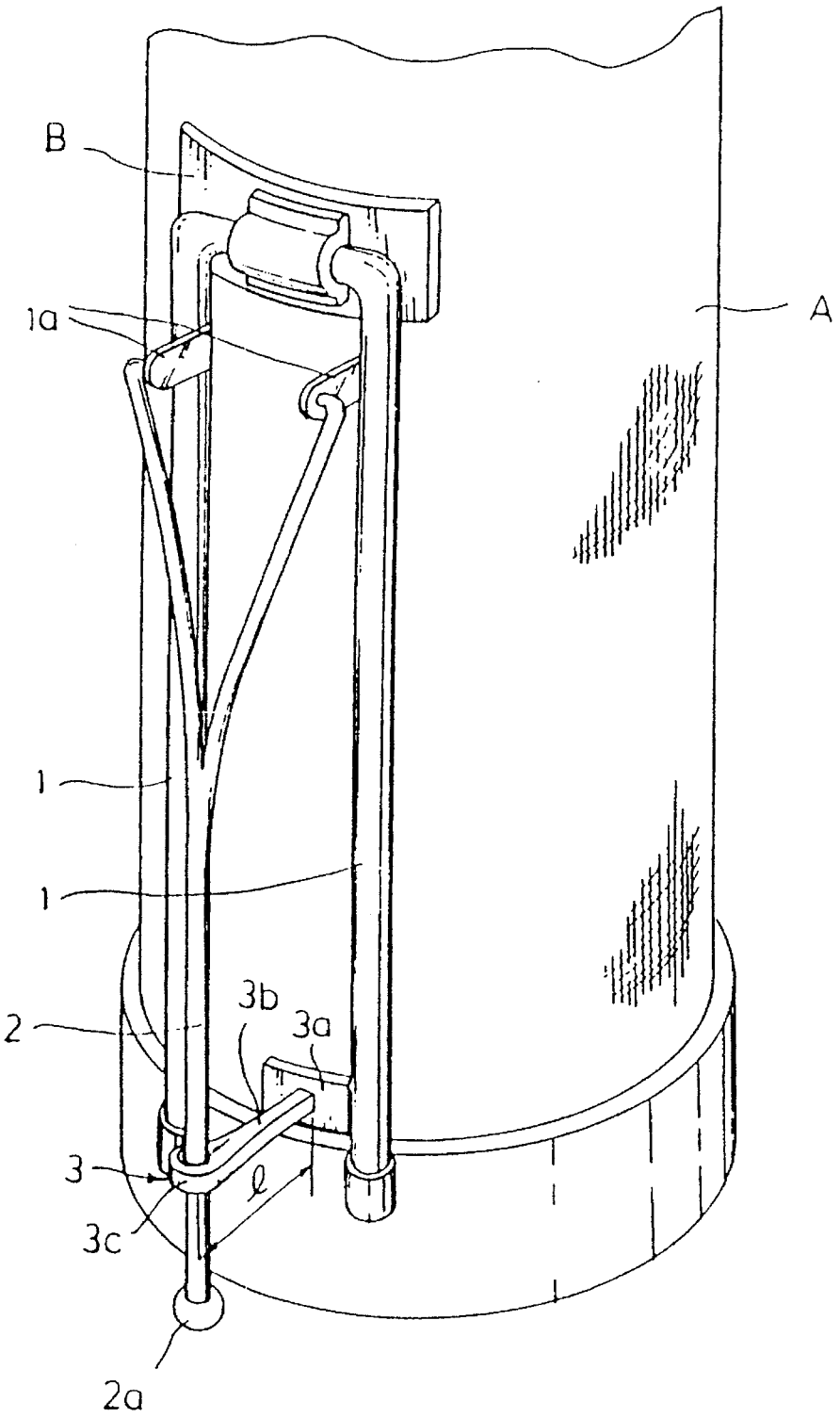
FIG. 1 is a perspective view of a golf bag with a support stand in accordance with an embodiment of the present invention.

Referring to FIG. 1, there is shown a golf bag with a support stand in accordance with an embodiment of the present invention. As shown in FIG. 1, the support stand is attached to a body A of the golf bag. The support stand includes a pair of support legs 1 pivotally mounted at their upper ends to a bracket B fixedly mounted to the upper end of the golf bag body A. For pivotally moving the legs 1 between an extended position and a retracted position, the support stand also includes an actuating member 2 having a pair of upper ends pivotally mounted to protrusions 1*a* provided respectively at the upper portions of legs 1. The actuating member 2 has a lower end being flush with the bottom surface of the golf bag body A at the retracted position of legs 1. A spacer bracket 3 is fixedly mounted to the lower portion of golf bag body A. The spacer bracket 3 serves to space the lower end of actuating member 2 a constant distance from the golf bag body A.

The protrusion 1*a* of each leg 1 is outwardly protruded a predetermined length from the leg 1 such that it extends in perpendicular to a line extending between the pivot point of the leg 1 and the lower end of the leg 1.

As shown in FIG. 1, the actuating member 2 has at its upper portion a branch shape providing a pair of upper ends each pivotally mounted to each corresponding protrusion 1*a*. Alternatively, the actuating member 2 may have a rod shape at its upper portion. At the lower end of actuating member 2, a contact plate 2*a* is provided so as to prevent the lower end of actuating member 2 from getting stuck into the ground.

In accordance with this embodiment, the spacer bracket 3 has a fixed portion 3*a* fixedly mounted to the golf bag body A, a spacer extension portion 3*b* outwardly extending from the fixed portion 3*a* to space the actuating member 2 a predetermined distance from the golf bag body A, and a slide hole 3*c* slidably receiving the actuating member 2. The slide hole 3*c* is provided at the outer end of spacer bracket 3. The spacer bracket 3 may have various constructions other than the illustrate construction. The distance ι between the actuating member 2 and the golf bag body A is desirable to be 2 to 15 cm.

Figure 2:
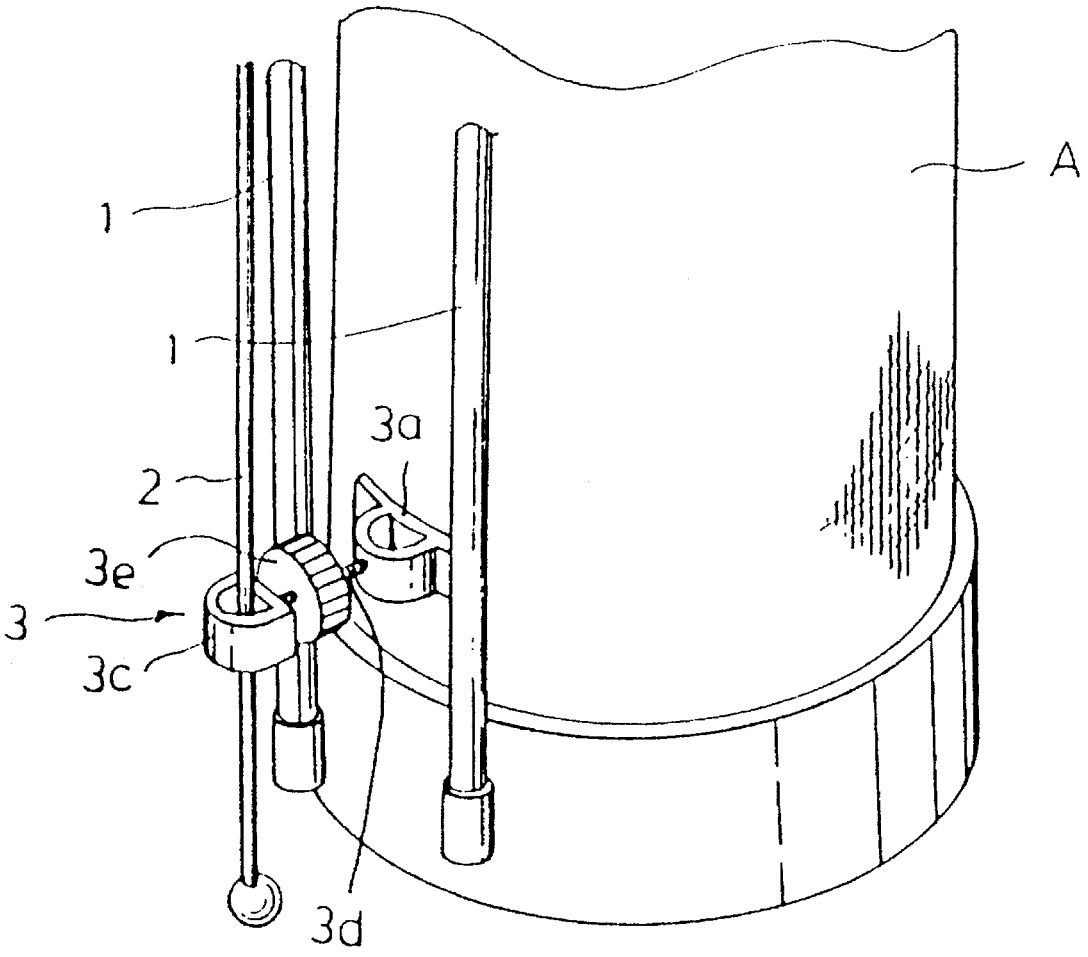
FIG. 2 is a perspective view illustrating a support stand including a mechanism for adjusting the length of a spacer bracket in accordance with another embodiment of the present invention.

In accordance with another embodiment of the present invention, the support stand includes a mechanism for adjusting the distance ι between the actuating member 2 and the golf bag body A. As shown in FIG. 2, the adjusting mechanism includes a screw 3*d* provided at the spacer extension portion 3*b* of spacer bracket 3 and an adjusting knob 3*e* fixedly mounted on the screw 3*d*. In this case, the screw 3*d* is threadedly coupled at its one end to the fixed portion 3*a* of spacer bracket 3 and at its other end to the outer end of spacer bracket 3. As the adjusting knob 3*e* rotates normally or reversely, the both ends of screw 3*d* are inserted into or retracted from the fixed portion 3*a* and the outer end of spacer bracket 3, respectively, thereby enabling the distance ι to be adjusted. This mechanism for adjusting the distance ι may have other construction.

Operation of the support stand having the above-mentioned construction will now be described.

Since the actuating member 2 is held at its lower end by the spacer bracket 3, the lower end of actuating member 2 is always spaced the constant distance ι from the golf bag body A.

Figure 3B:
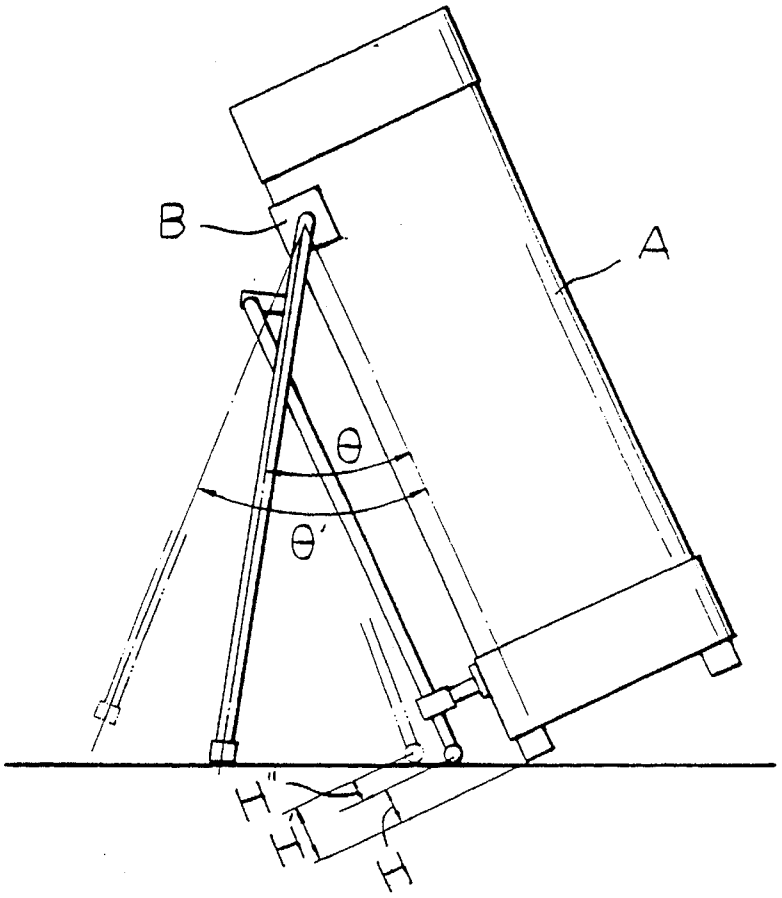
Figure 3A:
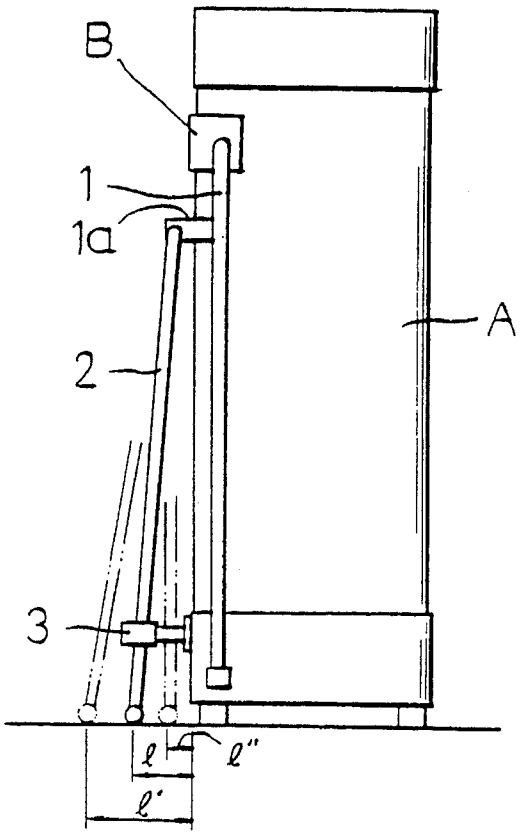

As the golf bag is moved from an upright position shown in FIG. 3*a* to a tilted position shown in FIG. 3*b* to extend the legs 1, the actuating member 2 spaced the distance ι from the golf bag body A is lifted a length H, as shown in FIG. 3*b*. By this upward movement of the actuating member 2, the upper ends of actuating member 2 push upwards the protrusions 1*a*, respectively, thereby causing the legs 1 to pivot about the bracket B. Accordingly, operations of extending and retracting legs can be achieved by the simple construction.

In the case of FIG. 2, it is possible to adjust the extension width of legs 1 by varying the distance ι between the actuating member 2 and the golf bag body A by an adjustment of the adjusting knob 3*e*.

For example, where the distance ι is to be increased to "ι'", the adjusting knob 3*e* is rotated such that the both ends of screw 3*d* are inserted a predetermined length into the fixed portion 3*a* and the outer end of spacer bracket 3, respectively. By this movement of the screw 3*d*, the distance between the actuating member 2 and the golf bag body A corresponds to the distance ι'. Under this condition, the lifted length of the actuating member 2 upon tilting the golf bag is varied from the length "H" into the length "H'". In other words, the lifted length of the actuating member 2 is increased by the length H". As a result, the pivot angle of the legs is increased from the angle θ to the angle θ', thereby causing the extension width of legs 1 to be increased. Thus, the extension width of legs 1 can be easily adjusted by varying the distance ι between the actuating member 2 and the golf bag body A. Where the golf bag is to be carried on a cart, the distance between the actuating member 2 and the golf bag body A is adjusted to correspond to the distance ι" smaller than the distance ι so as to eliminate a trouble occurring at the distance ι.

As apparent from the above description, the present invention provides a support stand for a golf bag having a simple construction capable of automatically extending legs upon storing or carrying the golf bag and automatically retracting the legs upon using the golf bag and thereby capable of reducing the labor taken for the manufacture thereof and the manufacture cost. In accordance with the present invention, the support stand also has a construction capable of adjusting the extension width of legs depending on a variation in circumstance and thereby supporting the golf bag more stably.

It must be understood that many alterations and modifications may be made by those having ordinary skill in the art to the structures disclosed herein without departing from the spirit and scope of the invention. Therefore, the presently illustrated embodiments have been shown only by way of example and should not be taken to limit the scope of the following claims.

What is claimed is:

1. A support stand for a golf bag comprising a pair of legs pivotally mounted to a body of the golf bag, further comprising:

an actuating member serving to pivotally move the legs and having upper ends each pivotally mounted to an upper portion of each corresponding one of the legs and a lower end being flush with a bottom surface of the golf bag body at an upright position of the golf bag; and a spacer bracket fixedly mounted at one end thereof to a lower portion of the golf bag and provided with means for holding the lower portion of the actuating member, the spacer bracket being adapted to space the actuating member a predetermined distance from the golf bag body and including means for adjusting the distance between the actuating member and the golf bag body.

2. A support stand in accordance with claim 1, wherein the adjusting means comprises:

a screw threadedly coupled at one end thereof to one end of the spacer bracket and at the other end thereof to the other end of the spacer bracket; and an adjusting knob fixedly mounted on the screw.

3. A golf bag including a bag body, a support stand having a pair of legs pivotally mounted to the bag body and an actuating member for the legs, said legs movable between extended and retracted positions by the actuating member, said actuating member having an upper portion pivotally mounted to the legs and a lower portion nearby the bottom of the bag body when the legs are in the retracted position, and a spacer bracket fixedly mounted to a lower portion of the golf bag which guides the actuating member as the legs move between extended and retracted positions, said spacer bracket including an adjustment mechanism for varying the distance between the actuating member and the golf bag body.

4. The golf bag of claim 3 where the adjustment mechanism includes a screw device having a manually adjustable knob.

5. A golf bag including a bag body, a support stand having a pair of legs pivotally mounted to the bag body and an actuating member for the legs, said legs movable between extended and retracted positions by the actuating member, said actuating member having an upper portion including a pair of leg connector elements and a lower portion extending downward and having an end terminating nearby the bottom of the golf bag body when the legs are in the retracted position and adapted to contact the ground during operation of the actuating member, said leg connector elements each being pivotally mounted to one of said legs, and a spacer bracket having a first end fixedly mounted to a lower portion of the bag body and a second end extending outward from the bag body to maintain the actuating member a constant, predetermined distanced from the bag body, said second end having a guideway through which the lower portion of the actuating member extends and which guides said lower portion of the actuating member as the legs move between extended and retracted positions.

6. The golf bag of claim 5 where said spacer bracket includes an adjustment mechanism for varying the distance between the actuating member and the golf bag body.

7. The golf bag of claim 5 where the distance is from 2 to 15 cm.

8. The golf bag of claim 5 where the actuating member has a Y-shape.

* * * * *